US008604372B2

(12) United States Patent
Yang et al.

(10) Patent No.: US 8,604,372 B2
(45) Date of Patent: Dec. 10, 2013

(54) PUSH BUTTON AND ELECTRONIC DEVICE HAVING SAME

(75) Inventors: He-Hui Yang, Shenzhen (CN); Qing-Qing Zheng, Shenzhen (CN); Kai-Kuei Wu, New Taipei (TW); Kun-Chih Hsieh, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 148 days.

(21) Appl. No.: 13/215,218

(22) Filed: Aug. 22, 2011

(65) Prior Publication Data

US 2012/0325634 A1 Dec. 27, 2012

(30) Foreign Application Priority Data

Jun. 22, 2011 (CN) ..... 2011 1 0168807

(51) Int. Cl.
*H01H 13/02* (2006.01)

(52) U.S. Cl.
USPC ..... 200/341; 200/345

(58) Field of Classification Search
USPC ..... 200/345
See application file for complete search history.

(56) References Cited

U.S. PATENT DOCUMENTS

| | | | | |
|---|---|---|---|---|
| 7,038,598 | B2 * | 5/2006 | Uke | 341/20 |
| 7,087,847 | B2 * | 8/2006 | Parkinson et al. | 200/5 A |
| 7,576,291 | B2 * | 8/2009 | Tseng et al. | 200/296 |
| 8,253,046 | B2 * | 8/2012 | Chen et al. | 200/5 A |
| 2003/0029709 | A1 | 2/2003 | Serizawa | |

FOREIGN PATENT DOCUMENTS

| | | | |
|---|---|---|---|
| CN | 201171003 | Y | 12/2008 |
| CN | 101924543 | A | 12/2010 |

* cited by examiner

*Primary Examiner* — Renee Luebke
*Assistant Examiner* — Ahmed Saeed
(74) *Attorney, Agent, or Firm* — Altis & Wispro Law Group, Inc.

(57) ABSTRACT

A push button for mounting on a shell includes a button body depressibly engaged in a through hole defined in the shell, a flexible circuit board, a rigid plate attaching to the shell and a conductive spring tab. The flexible circuit board is arranged between the a button body and the rigid plate. The flexible circuit board is brought into contact with the rigid plate. The flexible circuit board is electrically connected to a connector and includes a pair of normally-open contacts. The conductive spring tab is fixed to the flexible circuit board and aligned with the button body. The conductive spring tab is deformable. The button body is configured for being manually depressed so as to urge the conductive spring tab to deform and contact the pair of normally-open contacts, thereby generating a signal transmittable through the flexible circuit board to the connector.

5 Claims, 4 Drawing Sheets

PUSH BUTTON AND ELECTRONIC DEVICE HAVING SAME

BACKGROUND

1. Technical Field

The present disclosure relates to a button, especially to a push button and an electronic device having such a push button.

2. Description of Related Art

The manufacture and testing of a computer or data processing system is a complex matter, particularly when a large number of systems are manufactured and tested simultaneously. As used herein, the term computer system or data processing system includes not only general purpose computers, but also other types of computer-related systems that include some data processing capabilities.

An example of such a computer system is an electronic reading device. Such an electronic device includes one or more side buttons. During the manufacturing of the electronic reading device, the side button and its associated subassembly such as a circuit board will be tested to ensure that they function properly. It is desirable and useful if the structure of the electronic device can facilitate the testing of the side button and its associated subassembly.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
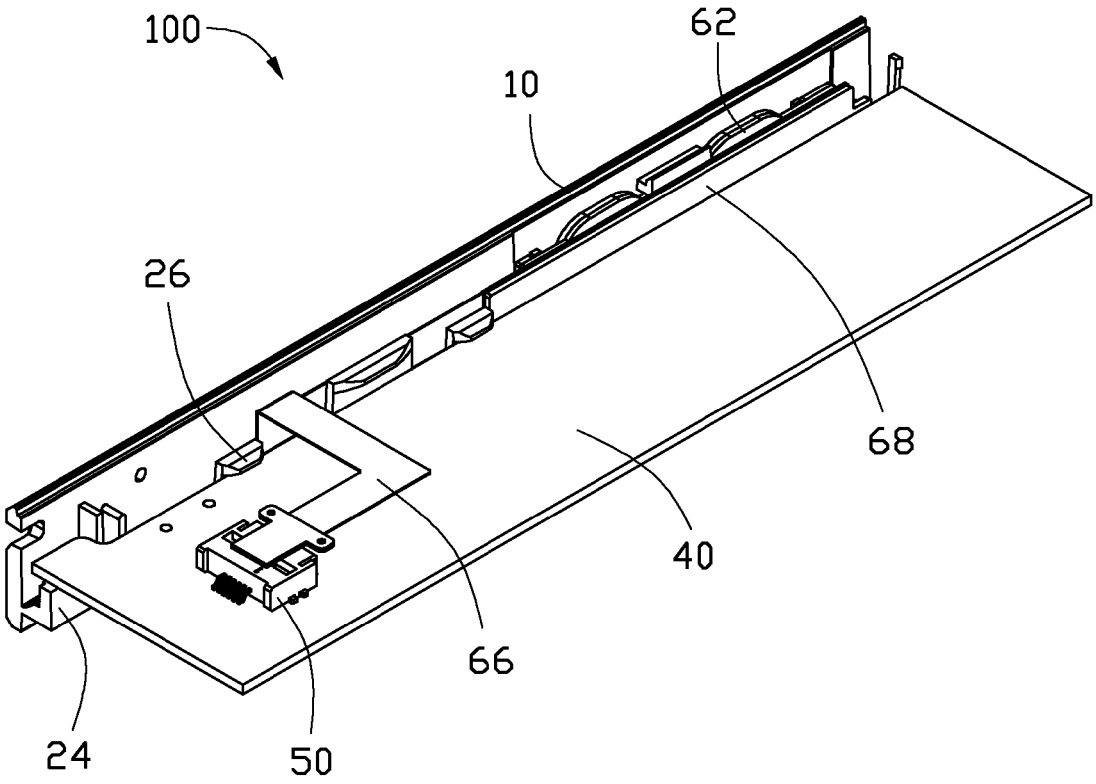
FIG. 1 is a partial, isometric view of an electronic device according to an exemplary embodiment.
Figure 2:
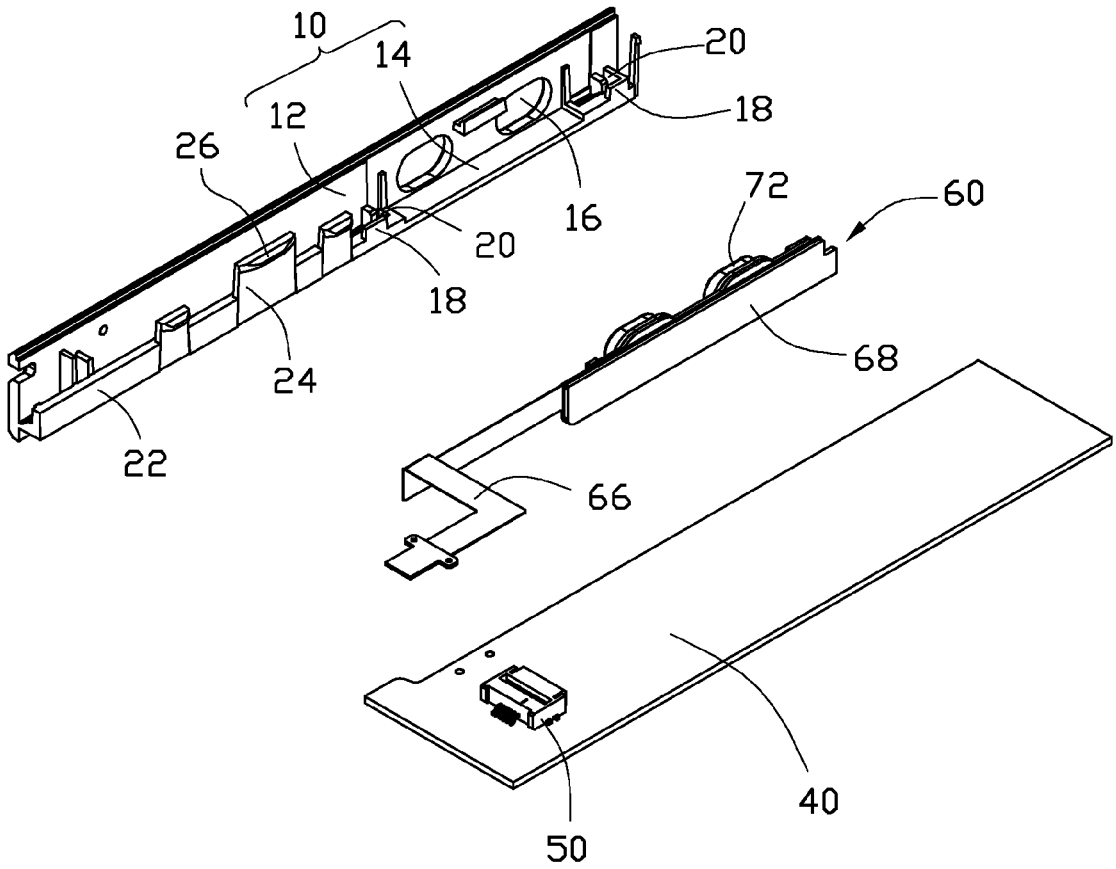
FIG. 2 is an exploded view of the electronic device in FIG. 1.

Referring to FIGS. 1 and 2, an electronic device 100 according to an exemplary embodiment includes a shell 10, a circuit board 40 and a push button 60. It is noted that only a portion of the shell 10 is illustrated for clarity purpose.

The shell 10 includes a panel body 12 and an elongated projection 14 perpendicularly protruding from the panel body 12. The panel body 12 is a substantially planar plate. The panel body 12 defines two through holes 16. The projection 14 extends along the lengthwise direction of the panel body 12 from one end to the opposite end. The projection 14 includes a number of protruding tabs 18. The protruding tabs 18 are located at opposite sides of the holes 16. Opposite openings 20 are located between protruding tabs 18 and the panel body 12. The projection 14 further includes a sidewall 22 and a number of restriction members 24 spaced and protruding from the sidewall 22. The restriction member 24 includes a hook 26 at its distal end. The hook 26 is higher than the sidewall 22.

A top surface and a bottom surface of the circuit board 40 respectively abut against the sidewall 22 and the hook 26. A connector 50 is mounted on the circuit board 40.

Figure 3:
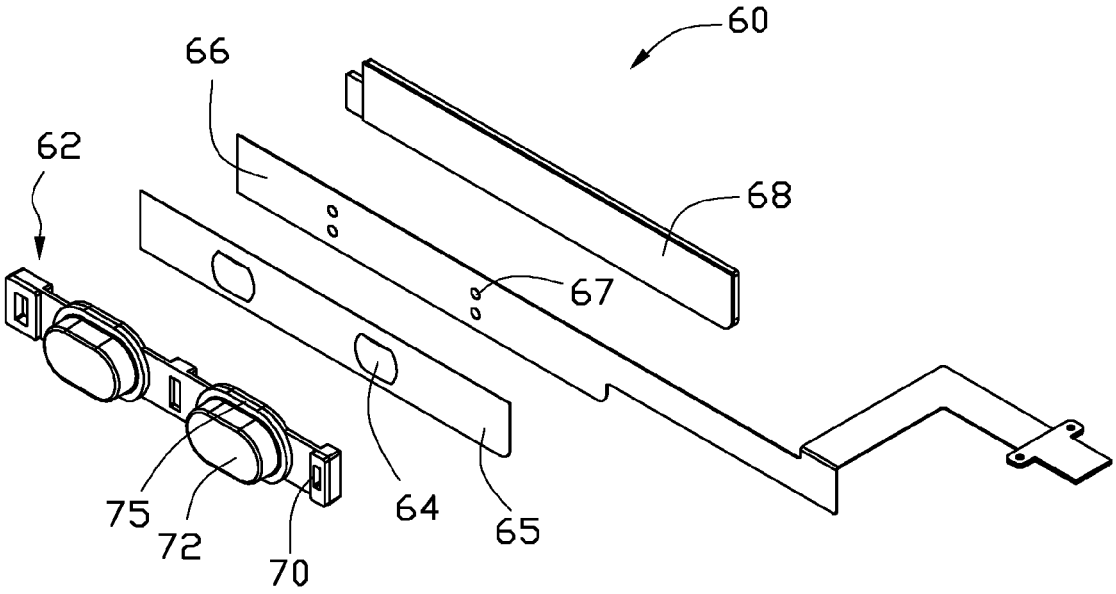
FIG. 3 is an exploded view of a push button in FIG. 2.
Figure 4:
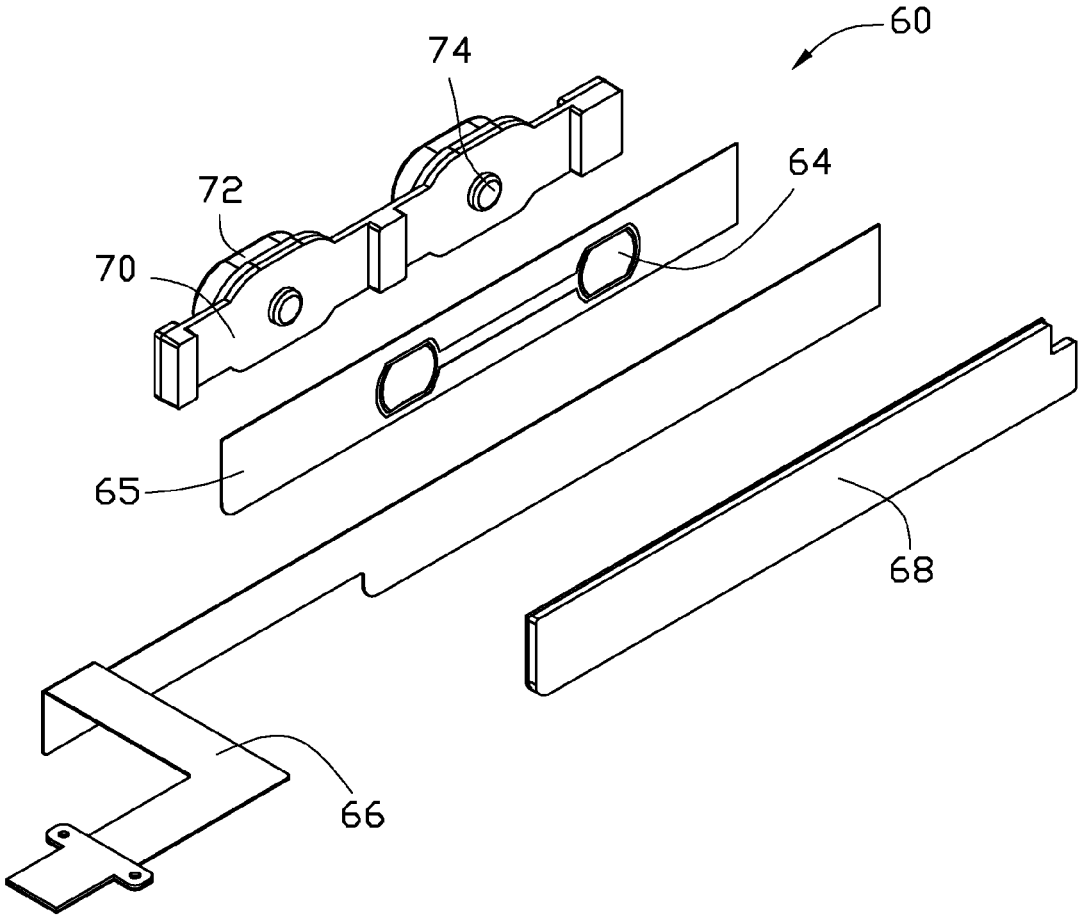
FIG. 4 is similar to FIG. 3, but viewed from a different viewpoint.

Referring to FIGS. 3 and 4, the push button 60 includes a pressing member 62, a piece of polymer film 65 mounted on two conductive spring tabs 64, a flexible printed circuit board 66, and a rigid plate 68. The piece of polymer film 65 and the rigid plate 68 are respectively attached to opposite sides of the flexible printed circuit board 66 by a conventional fixing technique, such as gluing. In the exemplary embodiment, the rigid plate 68 is made of metal.

The pressing member 62 includes an elastic base 70, two pressing portions 74, and two button bodies 72. The two pressing portions 74 are fixed to the same side of the elastic base 70 and respectively aligned with the two conductive spring tabs 64. The two button bodies 72 are fixed to the elastic base 70 opposite to the two pressing portions 74, respectively. Each conductive spring tab 64 is deformable when being pushed by the corresponding pressing portion 74.

The two button bodies 72 are respectively, depressibly engaged in the two through holes 12. Each button body 72 includes a flange 75 extending around its periphery and abutting against the inside surface of the shell 10, thereby preventing the button body 72 from disengaging from the corresponding hole 12.

The connector 50 is mounted on the circuit board 40. The flexible printed circuit board 66 includes two pairs of normally-open contacts 67. When one button body 72 is manually depressed to urge the corresponding conductive spring tab 64 to deform, the conductive spring tab 64 contacts the corresponding one pair of normally-open contacts 67, the pair of normally-open contacts 67 is then closed and can transmit a signal through the flexible circuit board 40 to the connector 50 When released, the button body 72 can restore under the action of the conductive spring tab 64.

Opposite ends of the rigid plate 68 are respectively engaged in the openings 20. The rigid plate 68 is brought into contact with the flexible circuit board 66 and can prevent the flexible circuit board 66 from being deformed when the conductive spring tab 64 is pushed by the button body 72.

A tactile feedback test of the button 60 can be performed with the subassembly as shown in FIG. 1. The test can be performed without the need of fixing the circuit board 40 to the shell 10, thereby simplifying the test.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An electronic device comprising:

a shell defining a through hole;

a circuit board comprising a connector mounted thereon; and a push button comprising:

a button body depressibly engaged in the through hole;

a rigid plate connected to the shell;

a flexible circuit board arranged between the button body and the rigid plate and brought into contact with the rigid plate, the flexible circuit board being electrically connected to the connector and comprising a pair of normally-open contacts; and a conductive spring tab fixed to the flexible circuit board aligned with the button body, the conductive spring tab being deformable, the button body configured for being manually depressed to urge the conductive spring tab to deform and contact the pair of normally-open contacts, thereby generating a signal transmittable through the flexible circuit board to the connector;

wherein the shell comprises a panel body and an elongated projection perpendicularly protruding from the panel body, the elongated projection comprises a sidewall and a number of spaced restriction members and protruding from the sidewall, each restriction member comprises a hook at its distal end, the hook is higher than the sidewall, a top surface and a bottom surface of the circuit board respectively abut against the sidewall and the hook.

2. The electronic device of claim 1, wherein the push button further comprise a polymer film, the conductive spring tab is mounted on the polymer film, the polymer film is fixed to the flexible circuit board.

3. The electronic device of claim 1, wherein the rigid plate is made of metal.

4. The electronic device of claim 1, wherein the shell includes two opposite openings, opposite ends of the rigid plate are respectively engaged in the openings.

5. The electronic device of claim 4, wherein two protruding tabs extend from the elongated projection, and the openings are respectively located between the protruding tabs and the panel body.

* * * * *